US007520044B2

(12) United States Patent
Bulliard et al.

(10) Patent No.: US 7,520,044 B2
(45) Date of Patent: Apr. 21, 2009

(54) AEROSOL CAN FABRICATION PROCESS

(75) Inventors: Jean-Maurice Bulliard, Posat (CH); Guenter Hoellrigl, Stein-am-Rhein (CH); Cedric Fanton, Tournon (FR)

(73) Assignee: Boxal France, Beaurepaire (FR)

( * ) Notice: Subject to any disclaimer, the term of this patent is extended or adjusted under 35 U.S.C. 154(b) by 641 days.

(21) Appl. No.: 11/182,191

(22) Filed: Jul. 15, 2005

(65) Prior Publication Data

US 2006/0021415 A1 Feb. 2, 2006

(30) Foreign Application Priority Data

Jul. 27, 2004 (FR) ..... 04 08283

(51) Int. Cl.

| | |
|---|---|
| ***B21B 1/46*** | (2006.01) |
| ***B21B 45/00*** | (2006.01) |
| ***B21C 23/18*** | (2006.01) |
| ***B21D 11/10*** | (2006.01) |
| ***B21D 51/02*** | (2006.01) |
| ***C22C 21/06*** | (2006.01) |
| ***C22F 1/04*** | (2006.01) |

(52) U.S. Cl. ..... 29/527.4; 72/46; 72/267; 72/379.4; 72/715; 148/440; 148/523; 148/688

(58) Field of Classification Search ..... 29/527.4; 72/46, 267, 379.4, 715; 148/415, 437, 440, 148/523, 535, 549, 688; 413/2, 69
See application file for complete search history.

(56) References Cited

U.S. PATENT DOCUMENTS 4,243,438 A * 1/1981 Yanagida et al. ..... 148/689
4,637,842 A * 1/1987 Jeffrey et al. ..... 148/535
6,945,085 B1 * 9/2005 Goda ..... 72/267
2001/0031376 A1 10/2001 Fulton et al.
2002/0014290 A1 * 2/2002 Dif et al. ..... 148/439

FOREIGN PATENT DOCUMENTS

EP 0 300 927 A1 1/1989
FR 2 457 328 12/1980

OTHER PUBLICATIONS

MatWeb 6060 Aluminum Composition Spec.*

* cited by examiner

*Primary Examiner*—David P Bryant
*Assistant Examiner*—Alexander P Taousakis
(74) *Attorney, Agent, or Firm*—Oliff & Berridge, PLC

(57) ABSTRACT

An aerosol can fabrication process comprises the following steps:

formation of slugs from an aluminium-based alloy having the following composition, in weight percentage:

| | |
|---|---|
| Si | 0.35-0.45 |
| Mg | 0.25-0.40 |
| Mn | 0.05-0.15 |
| Fe | 0.12-0.20 |
| Total of minor elements | ≦0.15% |
| Al | Balance. |

thermal treatment of the slugs,
forced cooling of the slugs,
cold impact extrusion of a slug so as to form a can,
applying a lacquer inside the can.

8 Claims, 2 Drawing Sheets

AEROSOL CAN FABRICATION PROCESS

BACKGROUND OF THE INVENTION

The invention relates to an aerosol can fabrication process comprising at least the following steps:

formation of slugs from an aluminium-based alloy,
thermal treatment of the slugs,
cooling of the slugs,
cold impact extrusion of a slug so as to form a can,
applying a lacquer inside the can.

STATE OF THE ART

Aerosol cans are generally made from an aluminium-based alloy comprising 99.7% in weight of aluminium, also called A7 or EN AW-1070A according to French standard NF 573-3, or more particularly from an aluminium-based alloy comprising 99.9% in weight of aluminium, also called A5 or EN AW-1050A according to French standard NF EN 573-3. To manufacture the aerosol cans, the alloy used is usually shaped into slugs of predetermined diameter. A strip is obtained by continuous casting, and then hot followed by cold rolling. The slugs are then cut out and thermally annealed. Then the aerosol cans are manufactured from the slugs by means of a cold impact extrusion step before an internal lacquer is applied inside the can and a printing step is performed on the outside wall of the can.

A5 and A7 alloys enable the slugs to be achieved continuously, and they present elongation and ductility properties particularly well-suited to forming aerosol cans. However, the mechanical characteristics of these alloys drop substantially in the application step of a lacquer inside the can. To overcome this drawback and in particular for the can to be able to withstand the internal pressure to which it is subjected in use, the walls of the can have to be thick, which leads to a large consumption of raw material.

The Patent Application FR-A-2457328 proposes to achieve an aerosol can using an aluminium-based alloy of the Aluminium-Magnesium-Silicon (Al—Mg—Si) family. Thus, an aerosol can is achieved from an alloy having the following composition (% in weight): Fe=0.19, Zr<0.01, Si=0.3, Mg=0.34, Cu<0.01, Zn<0.01, Ni<0.01, Ti=0.017, Mn<0.01, Cr<0.01, the balance being aluminium.

As indicated in FIG. 1, the fabrication process of aerosol cans comprising such an alloy consists in performing semi-continuous casting designed to form different Al—Mg—Si alloy plates. The plates then require thermal treatment for eight hours at 585° C. to homogenize the alloy. Then they are hot and cold rolled and cut to form slugs of predetermined diameter. The slugs are then treated by annealing in a furnace at 460° C. for one hour. Once they have been removed from the furnace, the slugs are cooled at ambient temperature. When in contact with the ambient air, the temperature of the slugs in fact decreases from 400° C. to 200° C. in forty minutes and then very slowly and linearly, until equilibrium is reached. The slugs are subsequently formed into aerosol cans, by cold impact extrusion. Once the cans have been formed, an internal lacquer is applied in each can and a polymerization step is performed at a temperature comprised between 180° C. and 250° C. for twenty minutes.

Thus, although presenting technical characteristics less sensitive to the thermal treatment performed for polymerization of the internal lacquer, it is nevertheless difficult to achieve such an alloy industrially. Unlike the alloy A5, the alloy proposed in the Patent Application FR-A-2457328 does not in fact enable slugs to be achieved continuously. Moreover, a very costly additional thermal homogenization treatment step has to be performed before the hot then cold rolling step. Finally, it is difficult to cold impact extrude slugs achieved with the proposed alloy.

OBJECT OF THE INVENTION

The object of the invention is to provide a fabrication process leading to aerosol cans having, for the same thickness, improved mechanical properties compared with aerosol cans according to the prior art and more particularly compared with aerosol cans made of A5 alloy. The object of the invention is also to provide a fabrication process remaining easy to implement, able to be industrialized, and less costly.

More particularly, this object is achieved by the fact that cooling of the slugs, after thermal treatment, is forced, and by the fact that the aluminium-based alloy has the following composition, in weight percentage:

| | |
|---|---|
| Si | 0.35-0.45 |
| Mg | 0.25-0.40 |
| Mn | 0.05-0.15 |
| Fe | 0.12-0.20 |
| Total of minor elements | ≦0.15% |
| Al | Balance. |

According to a development of the invention, the aluminium-based alloy comprises in weight percentage:

| | |
|---|---|
| Si | 0.40-0.45 |
| Mg | 0.30-0.35 |
| Mn | 0.08-0.12 |
| Fe | 0.12-0.20 |
| Total of minor elements | ≦0.15% |
| Al | Balance |

According to a preferred embodiment, during the forced cooling step, the temperature of the slugs is reduced exponentially by about 400° C. in two and a half hours.

According to another feature of the invention, forced cooling of the slugs can be performed by forced air or by immersion in water.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PARTICULAR EMBODIMENTS

Figure 1:
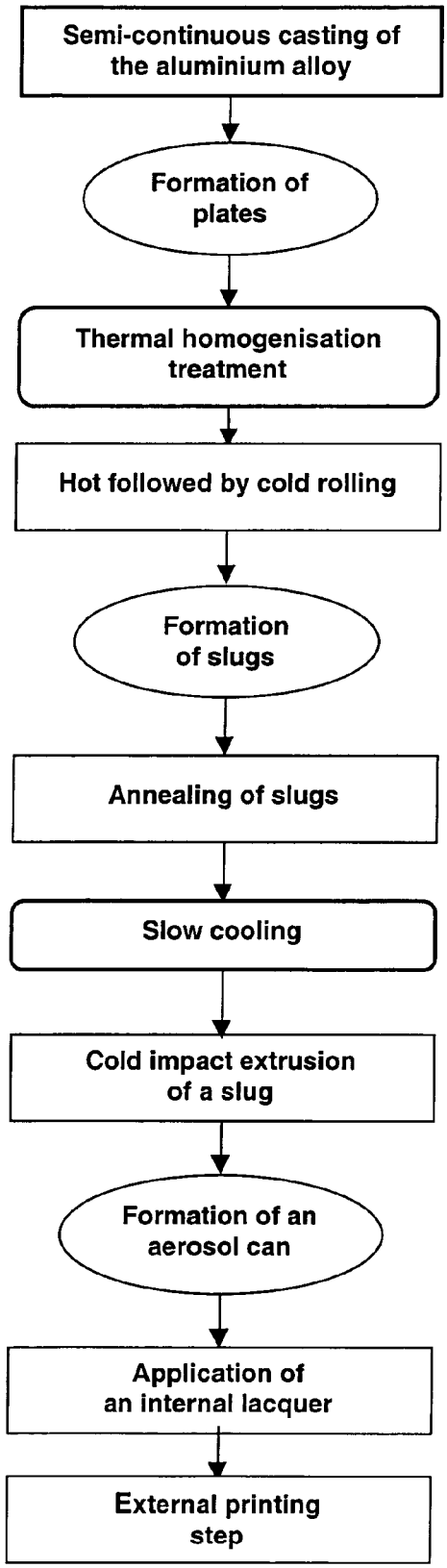
Fig. 1 (Prior art)
FIG. 1 schematically represents, in block diagram form, the different fabrication steps of an aerosol can according to the prior art.
Figure 2:
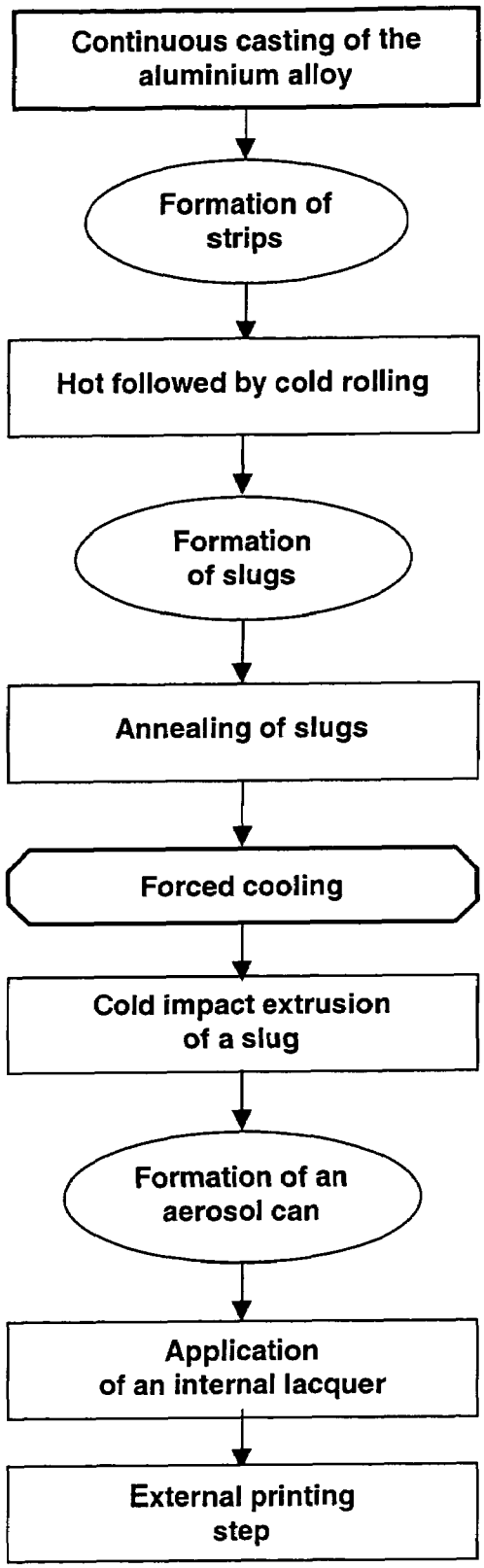
FIG. 2 schematically represents, in block diagram form, the different fabrication steps of an aerosol can according to the invention.

As represented in FIG. 2, the fabrication process of an aerosol can according to the invention, also called aerosol body or aerosol generating container, consists firstly in forming slugs from an aluminium-based alloy also called an aluminium alloy and having the following composition, in weight percentage:

| | |
|---|---|
| Si | 0.35-0.45 |
| Mg | 0.25-0.40 |
| Mn | 0.05-0.15 |
| Fe | 0.12-0.20 |
| Total of minor elements | ≦0.15% |
| Al | Balance. |

Preferably, the silicon, magnesium, manganese and iron contents are respectively strictly greater than 0.35% in weight, 0.25% in weight, 0.05% in weight and 0.12% in weight. More particularly, the alloy preferably comprises, in weight percentage:

| | |
|---|---|
| Si | 0.40-0.45 |
| Mg | 0.30-0.35 |
| Mn | 0.08-0.12 |
| Fe | 0.12-0.20 |
| Total of minor elements | ≦0.15% |
| Al | Balance |

Such an alloy in particular enables casting to be performed continuously. Thus, the aluminium-based alloy is melted in a furnace and then continuously cast, in liquid form, on a casting wheel comprising for example a water cooling system.

This enables a continuous solidified strip of aluminium-based alloy to be formed. The strip is wound on a winder after hot rolling before being subsequently unwound to be cold rolled. The rolling operation enables the thickness of a strip to be reduced to a predetermined thickness. The strip is then cut on a cutting press to form slugs or disks of predetermined diameter according to the dimensions required for the final cans.

The slugs then undergo thermal treatment (or annealing) for a time preferably comprised between four and a half and five hours, at a temperature preferably comprised between 465° C. and 490° C. A first annealing phase thus allows to eliminate the soluble oils located at the surface of the slugs in the course of the cutting step, and then the tensions created in the alloy when rolling is performed.

Thermal treatment is followed by a forced cooling step. By forced cooling, we mean that cooling of the slugs is imposed over a relatively short period of time, as opposed to a natural and slow cooling, at ambient temperature. Thus, when forced cooling is performed, the temperature is preferably reduced exponentially by about 400° C. in two and a half hours. For example, for an annealing temperature of 490° C., the temperature of the slug drops from 490° C. to 100° C. in two hours and thirty minutes. Forced cooling is for example performed by immersing the slugs in water or by forced air, i.e. in a blower.

Each slug then undergoes a cold impact extrusion step, which enables obtaining of a hollow cylindrical part forming the aerosol can. Impact extrusion of the slugs is performed by any type of known means in the field of aerosol can fabrication and it may be followed by finishing operations such as trimming of the can, washing, etc.

A layer of lacquer or varnish is then applied to the inside of the can. This layer of lacquer, for example a phenolic epoxy resin, is preferably applied by spraying followed by polymerization, at a temperature comprised between 200° C. and 250° C. for a period of time of less than 10 minutes. For example, the polymerization temperature is comprised between 220° C. and 225° C. and the polymerization time is six minutes. Polymerization at a temperature comprised between 200° C. and 250° C. accelerates the ageing process of the alloy. This has the consequence of very substantially improving the mechanical characteristics of the aerosol can. The can is then subjected to an external printing step designed to form patterns on the outside wall of the can. The can is then completed by a tapering step.

Unlike the alloy described in the Patent Application FR-A-2457328, the use of an aluminium-based alloy as described above and of a forced cooling step leads to an industrial fabrication process that is inexpensive and adaptable to the fabrication process used with the A5 alloy. This also provides aerosol cans having improved mechanical properties, for an equal thickness, compared with those of an aerosol can according to the prior art and more particularly compared with those of an aerosol can made of A5 alloy.

Moreover, performing forced cooling of the slug enables a relatively ductile slug to be obtained, which significantly reduces the extrusion force during the cold impact extrusion step. The extrusion force of a slug that has undergone forced cooling can in fact be reduced by 25% compared with a slug that has undergone slow cooling. It also causes a relatively large ageing effect of the aluminium-based alloy, which gives the can good final mechanical performances and in particular a good mechanical strength once the latter has been formed.

For comparison purposes, a can made with an A5 alloy and a can of the same thickness made with a forced cooling step and with a particular aluminium-based alloy, noted "B alloy", were mechanically tested. The B alloy has the following weight percentage composition:

| | |
|---|---|
| Si | 0.38 |
| Mg | 0.31 |
| Mn | 0.06 |
| Fe | 0.14 |
| Ti | 0.023 |
| V | 0.010 |
| Ga | 0.014 |
| Al | Balance. |

Table I below indicates the mechanical performances of the two cans respectively made of A5 alloy and B alloy. Thus, the Brinell hardness (Hb) of two slugs respectively formed by the A5 alloy and B alloy was measured. Tensile strength (Rm), elasticity limit or yield point (R 0.2) and elongation (A50) measurements were then realized on the cans made from these slugs, respectively after the impact extrusion step, after application of the coat of lacquer and on the finished can.

TABLE I

| | Hardness | After impact extrusion | | | After lacquer application | | | Finished can | | |
|---|---|---|---|---|---|---|---|---|---|---|
| | Hb of the slug | Rm (MPa) | R 0.2 (MPa) | A50 (%) | Rm (MPa) | R 0.2 (MPa) | A50 (%) | Rm (MPa) | R 0.2 (MPa) | A50 (%) |
| Alloy A5 | 21 | 152 | 138 | 1.7 | 138 | 134 | 1.3 | 133 | 127 | 1.6 |
| Alloy B | 33 | 190 | 175 | 3 | 195 | 180 | 3.6 | 180 | 165 | 4.5 |

Although the value of the Brinell hardness of the slug made of B alloy is slightly higher than that of the A5 alloy slug, it does however remain perfectly suitable for performing the cold impact extrusion operation.

On the other hand, unlike the A5 alloy, the mechanical performances of the can made of B alloy and in particular the tensile strength do not decrease after polymerization of the coat of lacquer. On the contrary, they increase slightly. Furthermore, the value of the elongation A50 of the can made of B alloy is 3.6% after the polymerization step of the layer of lacquer whereas for the A5 alloy, the elongation value A50 is only 1.3%.

Finally, the mechanical performances of the finished can made of B alloy are substantially greater than those of the finished can made of A5 alloy, the tensile strength being 180 MPa for the B alloy can whereas, for an A5 alloy can, the tensile strength is 133 MPa.

| | A5 alloy | B alloy |
|---|---|---|
| Initial strain (MPa) | 1.4 | 1.9 |
| Bursting pressure (MPa) | 2.1 | 3.0 |
| Vacuum strength (MPa) | −0.04 | −0.06 |
| Piercing resistance (°) | 56 | 66 |

Table II below also indicates first deformation, bursting pressure, vacuum strength and piercing or dent resistance measurements of the two cans.

Thus, the use of an alloy comprising from 0.35 to 0.45% in weight of Si, from 0.25 to 0.40% in weight of Mg, from 0.05 to 0.15% in weight of Mn, from 0.12 to 0.20% in weight of Fe, and up to 0.15% of minor elements, the balance being aluminium, and of a forced cooling steps leads to a slug having extrusion parameters relatively close to those of a slug made of A5 alloy while obtaining better final performances. Moreover, the fabrication process used is inexpensive, easy to implement and able to be industrialized. The gain in mechanical performances also enables aerosol cans to be fabricated with less raw material. For example, to obtain mechanical performances equivalent to those of aerosol cans made from A5 alloy, the thickness of the aerosol cans obtained according to the fabrication process according to the invention can be reduced by 15%.

The invention claimed is:

1. An aerosol can fabrication process comprising at least the following steps:

formation of slugs from an aluminium-based alloy having the following composition, in weight percentage:

| | |
|---|---|
| Si | 0.35-0.45 |
| Mg | 0.25-0.40 |

-continued

| | |
|---|---|
| Mn | 0.05-0.15 |
| Fe | 0.12-0.20 |
| Total of minor elements | ≦0.15% |
| Al | 98.65-99.23, |

thermal treatment of the slugs, forced cooling of the slugs, cold impact extrusion of a slug so as to form a can, applying a lacquer inside the can.

2. The process according to claim 1, wherein the aluminium-based alloy comprises, in weight percentage:

| | |
|---|---|
| Si | 0.40-0.45 |
| Mg | 0.30-0.35 |
| Mn | 0.08-0.12 |
| Fe | 0.12-0.20 |
| Total of minor elements | ≦0.15% |
| Al | 98.73-99.10. |

3. The process according to claim 1, wherein forced cooling of the slugs is performed by forced air.

4. The process according to claim 1, wherein forced cooling of the slugs is performed by immersion in water.

5. The process according to claim 1, wherein the formation step of the slugs comprises formation of a strip of aluminium-based alloy by continuous casting, the strip then being hot then cold rolled before being cut into the form of slugs having a predetermined diameter.

6. The process according to claim 1, wherein the application step of the lacquer is achieved by spraying followed by polymerization performed at a temperature comprised between 200° C. and 250° C. for a period of time of less than 10 minutes.

7. An aerosol can fabrication process comprising at least the following steps:

formation of slugs from an aluminium-based alloy having the following composition, in weight percentage:

| | |
|---|---|
| Si | 0.35-0.45 |
| Mg | 0.25-0.40 |
| Mn | 0.05-0.15 |
| Fe | 0.12-0.20 |
| Total of minor elements | ≦0.15% |
| Al | 98.65-99.23, |

thermal treatment of the slugs, forced cooling of the slugs, cold impact extrusion of a slug so as to form a can, applying a lacquer inside the can wherein, during the forced cooling step, the temperature of the slugs is reduced exponentially by about 400° C. in two and a half hours.

8. An aerosol can fabrication process comprising at least the following steps:

formation of slugs from an aluminium-based alloy having the following composition, in weight percentage:

| | |
|---|---|
| Si | 0.35-0.45 |
| Mg | 0.25-0.40 |
| Mn | 0.05-0.15 |
| Fe | 0.12-0.20 |

-continued

| | |
|---|---|
| Total of minor elements | ≦0.15% |
| Al | 98.65-99.23, |

thermal treatment of the slugs, forced cooling of the slugs, cold impact extrusion of a slug so as to form a can, applying a lacquer inside the can wherein thermal treatment of the slugs is performed at a temperature comprised between 465° C. and 490° C. for a time comprised between 4 hours and 5 hours.

* * * * *